US007520625B2

(12) United States Patent
De Dicastillo

(10) Patent No.: US 7,520,625 B2
(45) Date of Patent: Apr. 21, 2009

(54) HIGH VISIBILITY REFLECTIVE SYSTEM

(76) Inventor: Victoria Segura López De Dicastillo, Castelló, 20-4°D Madrid (ES) 28001

( * ) Notice: Subject to any disclaimer, the term of this patent is extended or adjusted under 35 U.S.C. 154(b) by 293 days.

(21) Appl. No.: 10/590,200

(22) PCT Filed: Feb. 24, 2004

(86) PCT No.: PCT/ES2004/000082

§ 371 (c)(1),
(2), (4) Date: Aug. 22, 2006

(87) PCT Pub. No.: WO2005/084467

PCT Pub. Date: Sep. 14, 2005

(65) Prior Publication Data

US 2007/0195414 A1 Aug. 23, 2007

(51) Int. Cl.
*A41D 13/01* (2006.01)

(52) U.S. Cl. ..... 359/519; 428/99; 362/108

(58) Field of Classification Search ..... 428/99, 428/100; 359/519; 2/338, 339
See application file for complete search history.

(56) References Cited

U.S. PATENT DOCUMENTS

| | | | |
|---|---|---|---|
| 2,709,393 | A | 5/1955 | Anderson |
| 5,245,516 | A | 9/1993 | de Haas et al. |
| 5,381,318 | A | 1/1995 | Fang |
| 5,624,065 | A | 4/1997 | Steffe |

FOREIGN PATENT DOCUMENTS

| | | |
|---|---|---|
| EP | 0 124 786 | 11/1984 |
| GB | 2 382 612 | 6/2003 |

*Primary Examiner*—Alexander Thomas
(74) *Attorney, Agent, or Firm*—Wenderoth, Lind & Ponack, L.L.P.

(57) ABSTRACT

The hereby described system, which provide an increased visualization of the person or object fitted with this device, comfortable and easy to carry, due to its small size and adaptability. The system includes a main device with a frame fitted with a space with the first reflective band, and other empty spaces ready to be fitted with extractable cartridges, and kept in place by means of a protuberance of the frame provided with an opening for each extractable cartridge. The bands and the cartridges are equipped with complementary connecting devices, among themselves and with those of the main device.

5 Claims, 3 Drawing Sheets

A - A

HIGH VISIBILITY REFLECTIVE SYSTEM

PURPOSE OF THE INVENTION

Figure 1:
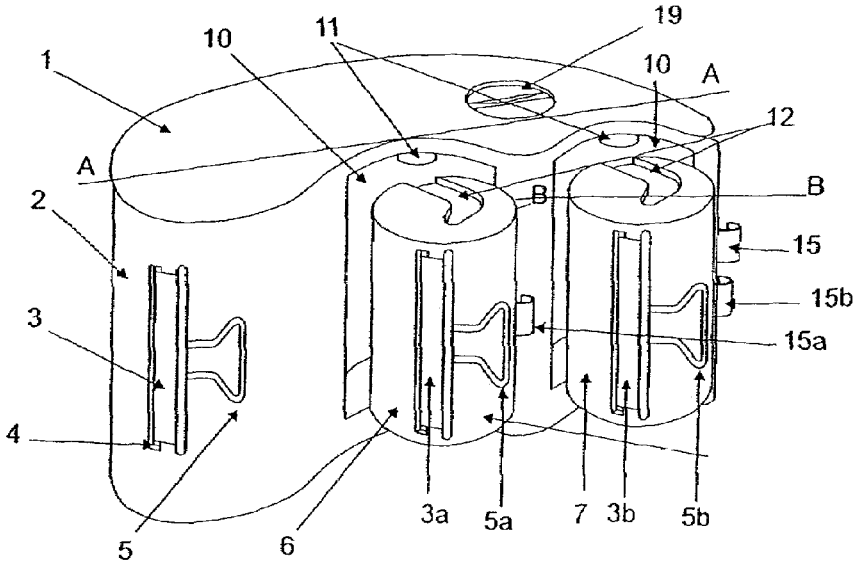

This invention consists in a high visibility reflective system, which provides essential characteristics of novelty and considerable advantages as regards all known and used means with the same aims in actual technical devices.

In particular, the invention proposes the development of a system which will provide a person, an object, an obstacle or whatever it may be, which will cause some kind of risk, with a high visibility degree which will enable it to be visible in absence of natural or artificial light. The system of this invention is associated with a frame, designed for this purpose, providing sufficient reflective material to adapt to most situations in everyday life and designed to be easily tied to a person's waist, to be carried in a bag, in the pouch of a motorcycle or any other vehicle, or wherever it may be, due to its adaptability and small size.

The field of application of the invention is obviously industrial, and within the sector dedicated to the manufacturing of safety devices for persons, vehicles and objects in general.

ANTECEDENTS AND SUMMARY OF THE INVENTION

It is widely known that for many years, reflective devices have been used to visualize persons or objects, in cases of reduced visibility and in places where some kind of risk can arise out of this lack of visibility. For instance we can mention the reflecting jackets used by workers of some public services (policemen, firemen, rubbish collectors, road maintenance personnel . . . etc), so that the persons wearing the reflective jackets can be clearly seen in places where they carry our their work and even if there is a limited visibility, and thus avoiding unnecessary accidents.

These reflective jackets fill properly their task, and provide an easy and efficient visualization of the bearers in the previously mentioned conditions. But however, and in spite of their undoubted efficiency, the actual devices also have some disadvantages, specially in connection with the fact that they hide the identity of the person or the profession of the bearers, being devices covering the body from hip to neck and of a certain size. It is also an specific device developed for a given application, not easily adapted or uncomfortable in other situations.

The main aim of this invention has been to develop a system providing efficient solutions to the inconvenients mentioned in the previous paragraph, by means of high visibility reflective means, to be used in very differentiated situations. The main characteristics which define the system of this invention are contained in Claim 1).

Basically, the device object of the invention has been structured around a frame, preferably plastic material, with a closed compartment in one end, integrated in the frame, where a not extractable reflective band (retro-reflective, phosphorescent or fluorescent) is contained and associated with conventional means of automatic winding which produce the winding of the band when it is not receiving any traction tension. The rest of the frame has been designed with two pockets containing two cartridges with other bands of the same type and similar to the band included in the mentioned fixed compartment. However, these two cartridges are extractable and they can be removed from the frame when the bands have to be used separately or combined with one another and/or with the band contained in the fixed pocket of the frame. The bands and the cartridges are provided with conventional attaching means for their quick and simple fixing in operative positions. Besides, each band and the respective cartridge, or the frame itself, can incorporate magnetic devices (with the corresponding magnet) to enable the device to be fixed, by simple contact, with any metallic surface.

It is evident that the herein presented system is highly changeable and has multiple application possibilities, not only for the easy visualization of persons, but also for signposting of obstacles and sundry items, to make them easily detectable and avoid all dangers derived from insufficient or bad lighting.

SHORT DESCRIPTION OF THE DRAWINGS

The above and other characteristics and advantages of the invention are more clearly seen by the detailed manufacturing description, provided only as an illustrative but not limitative reference, where:

FIG. 1 shows a schematic general view, in perspective, of the preferred execution of the invention system.

Figure 2A:
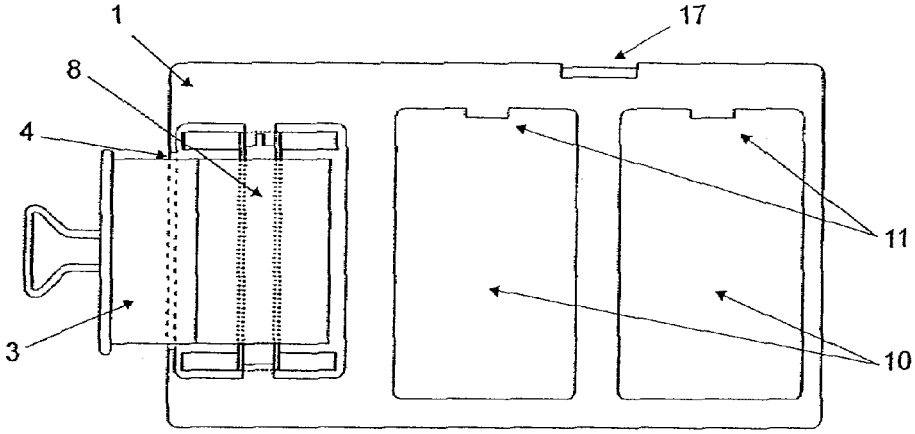
Figure 2B:
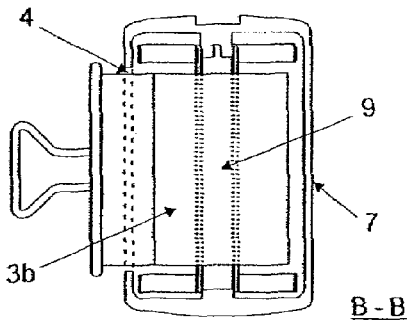
Figure 3:
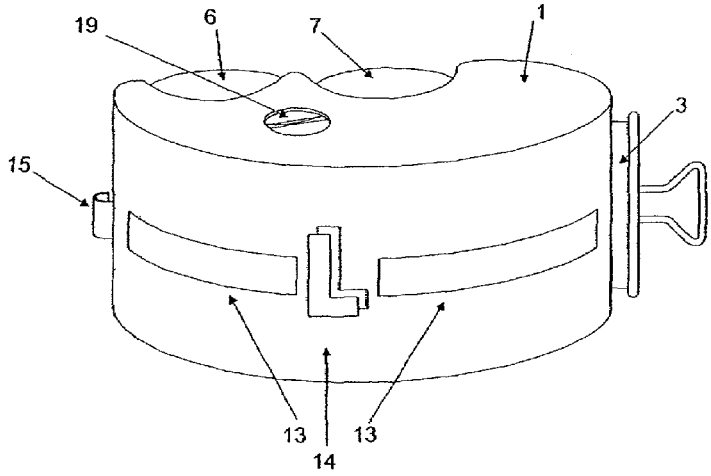
Figure 4A:
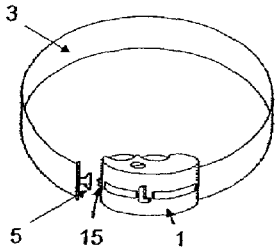
Figure 4B:
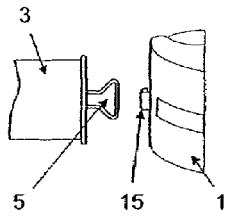
Figure 4C:
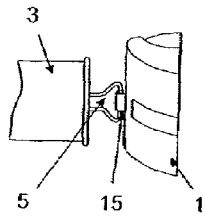
Figure 5A:
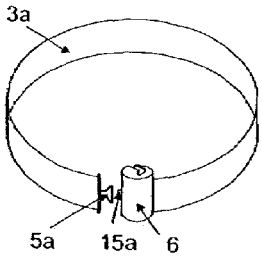
Figure 5B:
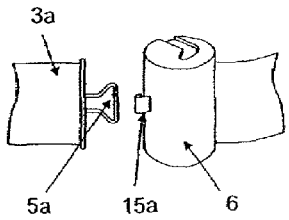
Figure 5C:
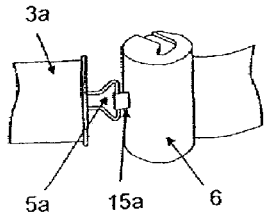
Figure 6A:
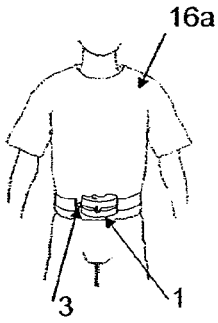
Figure 6B:
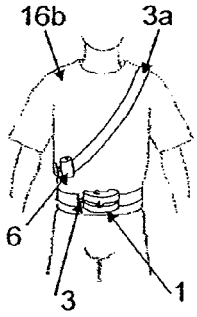
Figure 6C:
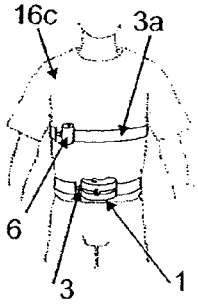
Figure 6D:
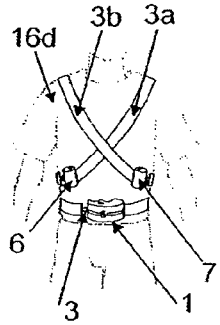
Figure 7:
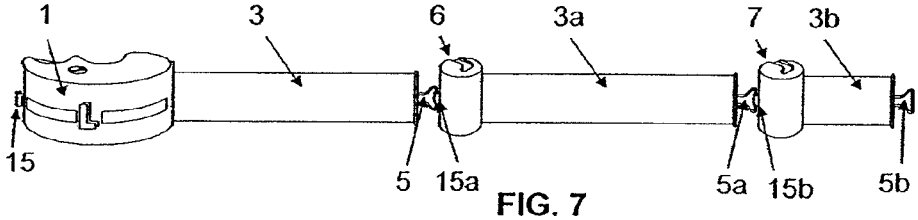
Figure 8A:
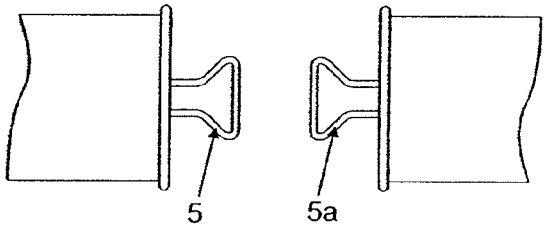
Figure 8B:
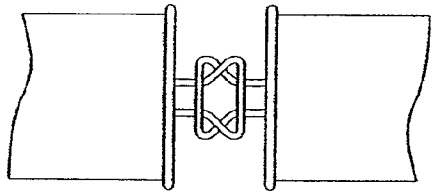
Figure 9A:
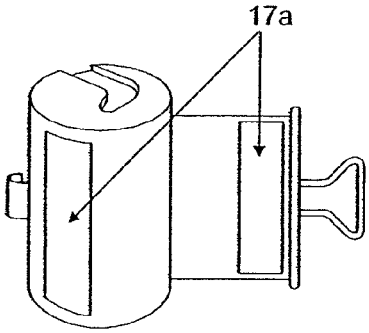
Figure 9B:
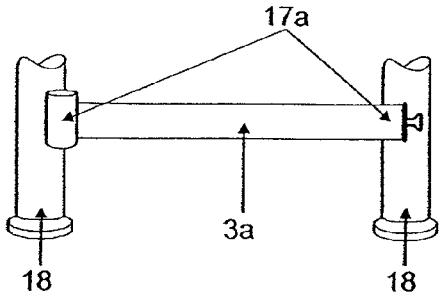

FIG. 2*a* shows an elevational view of the respective sections, taken from lines A-A of FIG. 1;

FIG. 2*b* shows an elevational view of the respective sections, taken from lines B-B of FIG. 1;

FIG. 3 is a perspective of the device of the FIG. 1 seen from the opposite side, being the external part of the device when applied;

FIGS. 4*a*, 4*b*, and 4*c* show the fixation means for the reflective band and the frame of the device, and collectively illustrate the attachment sequence;

FIGS. 5*a*, 5*b*, and 5*c* show the fixation means between the extractable cartridges incorporated in the frame of the main device and its own reflective band, and collectively illustrate the attachment sequence;

FIGS. 6*a*, 6*b*, 6*c*, and 6*d* illustrate several possibilities for the utilisation of the invention system when applied to persons;

FIG. 7 shows an schematic view of the combined use of the extractable cartridges with the main device with the light pattern;

FIGS. 8*a* and 8*b* show an application sequence between two reflective bands, and FIGS. 9*a* and 9*b* show an application sequence when the bands and the cartridges incorporate magnetic fixation means.

DESCRIPTION OF THE PREFERRED REALISATOIN WAY

In accordance with the previous paragraphs, the detailed description of the preferred realisation way is to be done with the help of the enclosed drawings, which show the same numeric references to mention similar or equal parts. Consequently, if FIG. 1 of the drawings is analised, it can be clearly seen that the system proposed by this invention includes a main device with the general reference number 1, and configurated like a frame and which regarding each one of its ends increases its width to determine a space 2 prepared to contain a reflective band 3 which comes to the outside through an opening 4 made in the side of space 2, this band being provided with an attachment means 5, hooklike, made in metallic wire or rod with a small diameter, and closed on itself. The remaining space of the frame of the main device 1, has two large empty spaces 10, able to admit extractable cylindric cartridges under references 6 and 7 respectively, which will contain their reflective bands 3*a* and 3*b*, which have attachment devices 5*a* and 5*b* at their respective ends, hooklike shaped and closed on themselves. The characteristics of these bands 3*a* and 3*b*, are coincident in general with those of band 3 placed in space 2 of the main frame 1. Besides, each empty space 10 represents a protuberance 11, formed on the upper base of each empty space, to be coupled through an opening 12 on the upper base of each of the cartridges 6 and 7, when these cartridges are placed in the corresponding space 10, which makes each cartridge to be fixed and kept in space 10. This system produces only the effect of relative retention, as each cartridge 6 and 7 can be extracted by the user when needed, simply by exerting a light manual traction on the same.

Basically, the configuration of the main device 1 of the invention is coincident with the above description. Nevertheless, even if the preferred realisation provides three bands in total, 3, 3*a*, 3*b*, located in place 2 of the frame and extractable and independent cartridges 6 and 7, the number of empty spaces 10, and therefore the number of cartridges can be higher if so needed or desired by the application the device is going to fill. Therefore, the provided explanation for the two extractable cartridges can be perfectly extrapolated to different numbers of cartridges, provided the relative number of empty spaces is designed.

In the FIG. 2 shows sections of lines A-A and B-B of FIG. 1, and section A-A affects the main device and shows the inside of space 2, with band 3 winding on a central rotating nucleus 8 which, as stated, can incorporate some conventional elastic recovering means for the automatic winding of the reflective band 3 when traction is not applied on the same, while section B-B affects the extractable cartridge 7 (equal to extractable cartridge 6) where the reflective band 3*b* is winding through a central rotating nucleus 9, which can also be associated with automatic recovering means.

In connection with FIG. 3, it presents a general view in perspective of the same main device 1 of FIG. 1, but in this case taken from the opposite side, which would be the external side after the whole device is placed on the user subject. The frame has been also provided with transparent spaces 13, one at each side, placed on the longitudinal direction of the body of the device, at an intermediate height and which do not meet; in a centered position and separating both pieces, another piece 14, designed in double "L" shape, where a light source (not shown) can de placed, which is a light source provided with a small battery (por instance, similar to those used by watches), protected by a cover made of the same material of the device, which can be placed, in accordance with the requirements, in the upper side of the frame 19. Also, and regarding the end of the frame opposite to the fixed place 2, a retention device 15 is contemplated, designed with a curved profile to enable the attachment of means 5, associated with the respective end of the reflective band.

After the different engineering and structural characteristics of the elements of the invention system have been described, the following will try to explain some examples of the use of the system.

Thus, FIG. 4 shows device 1 in operative position which means with the reflective band 3 outside its container and showing sufficient band length to be coupled at the body of a person or to some object, as required. The sequence shows how the union of the hooking device 5 associated with the end of band 3 and element 15 associated to the frame of the device 1 are joined, by introducing this retention element 15 inside the coupling 5.

The same sequence can be seen in connection with FIG. 5, but in this case it is applied to an extractable cartridge, that is, cartridge 6 of reflective band 3*a*, its hooking element 5*a* being coupled with retention element 15*a*, and acting in the same way as the main device of FIG. 4.

If FIG. 6 is considered, the use of the different elements of the system can be seen, as well as the possibility of combination among them all, in order to provide a clear visualization of the bearer or user. In the presented case, a person is shown with numeric references 16*a* to 16*d*, with the different possible alternatives covering the use of one, two or three reflective elements. In the first case, person 16*a* is only using the main device 1 with reflective band 3 round his waist; in the second case, person 16*b* combines the use of the main device 1 in the same position as in 16*a* with the use of extractable cartridge 6, with reflective band 3*a* crossed over the chest of the user; the third shows person 16*c* using the main device 1 and one extractable cartridge 6, but in this case the band is crossing transversally the chest of the user, at mid-height; and the fourth shows the use of the three cartridges, main device 1 and the two extractable bands 6 and 7, of which number 3 has been adapted to the waist of the user 16*d* as in the previous cases and the other two bands, 3*a* and 3*b*, over both shoulders, crossed over the chest and the back of the user.

It is clear that the reflective bands are extremely easy to put into position comfortably and quickly, due to the provision od the recuperation means placed in the fixed space 2 and in both cartridges 6 & 7, thus permitting different options of use.

It has also to be taken into consideration that the description presents a person who, for whatever reason, must move in places with bad or insufficient lighting. Bur this use must be taken only on an illustrative basis, as the field of application does not only cover persons but also any kind of object or obstacle which needs to be clearly spotted in similar conditions, including vehicles or objects in movement or any element in a fixed position.

FIG. 7 presents another possibility of use of the set of elements proposed by the invention system, consisting in the connection of the three described components to obtain a bigger final length. The elements can be interconnected, by using the engaging means 5, 5*a*, 5*b*, ready to be interconnected among themselves or by retention means 15, 15*a* & 15*b*, placed in the main device 1 as in each cartridge 6, 7. Thus, a considerable distance can be covered only by joining all the elements, considering that the length of the bands will vary depending on the desired use.

The possibility of joining the bands through 5, 5*a* & 5*b* is more clearly seen in FIGS. 8*a* & 8*b* of the drawings. The first of these Figures represents two connections 5 & 5*a* ready to pass one of them through the closed space of the other, to be then rotated and to form the union shown in FIG. 8*b*. This form of interconnection is already known and it is used by this invention due to its simplicity and quickness.

FIG. 9*a* shows another peculiarity of the described system. Cartridges 6 & 7 and their respective reflective bands 3*a* & 3*b* can be provided with their respective magnetic means 17*a* & 17*b*, to enable them to be fixed on metal surfaces by simple contact. This situation is clearly represented in FIG. 9*b*, where reflective band 3*a* is extended between two metal poles 18 with cartridge 6 magnetically attached to one of the poles and the other end to the opposite pole.

It is not important what kind of magnets are used, and therefore any magnet will do, either stuck or embedded and in the required position and number.

The system proposed by this invention is extremely easy and comfortable to carry and wear given its small size and low weight, and the user can have it at hand and make use of it whenever the need arises.

It is not necessary to insist on this description as an expert will easily understand the scope of use and the advantages derived from the invention and will also put into practise the aim of the same.

However, it is to be understood that the description shows the preferred use of the invention and that it can be modified without alteration of the fundaments of the invention. The modifications will alter, basically, the shape, size and/or manufacturing materials of the system or part of it.

The invention claimed is:

1. A high visibility reflective system, designed for easy and quick visualization of persons, objects or obstacles, comprising:

a main device formed by a frame designed to have a pocket or chamber at one of its ends, containing a reflective band winding on a rotating shaft, with automatic winding means, coming out through an opening at the walls of the pocket and provided, at its free end, with a connecting hook, and having two empty spaces within the frame, designed to admit extractable cartridges;

the frame of the main device having incorporated, at the opposite end of the outlet of the band, a retention element, complementary of the connecting element of the reflective band;

each one of the extractable cartridges having a generally cylindrical shape and designed to be fitted into an empty space of the frame, and containing a reflective band winding on a rotating shaft provided with automatic winding means and connecting devices to be hooked to the connecting element of the main device or the other cartridges and the retention element, also included in each of the extractable cartridges.

2. The system in accordance with claim 1 wherein coupling and retention of each cartridge in the empty spaces of the frame of the main device is made through a protuberance formed in the upper side of each empty space, being designed and prepared to be connected in an opening in the upper side of each extractable cartridge.

3. The system in accordance with claim 1, wherein either of the extractable cartridges and the reflective band is provided with magnetic means for fixing, by simple contact, to metal surfaces.

4. The system, in accordance with claim 1, comprising means for fitting to persons or objects in places with a poor or no lighting.

5. The system in accordance with claim 1, wherein the main device and extractable cartridges are connectable among themselves to form a line of light with the reflective bands.

* * * * *